US006069596A

United States Patent [19]

Marvin et al.

[11] Patent Number: 6,069,596

[45] **Date of Patent: *May 30, 2000**

[54] ELECTRONIC SHELF LABEL MOUNTING SYSTEM

[75] Inventors: Russel H. Marvin, Webster, N.Y.; Donald W. Carr, Birmingham, Mich.

[73] Assignee: NCR Corporation, Dayton, Ohio

[ * ] Notice: This patent is subject to a terminal disclaimer.

[21] Appl. No.: 08/245,196

[22] Filed: May 17, 1994

[51] Int. Cl.[7] ..... G09F 3/20

[52] U.S. Cl. ..... 345/52; 40/649

[58] Field of Search ..... 345/33, 48, 52; 40/642, 647, 649; 340/825, 635

[56] References Cited

U.S. PATENT DOCUMENTS

| | | | |
|---|---|---|---|
| 4,002,886 | 1/1977 | Sundelin | 235/283 |
| 4,500,880 | 2/1985 | Gomersall et al. | 340/825.35 |
| 4,562,657 | 1/1986 | Murray | 40/642 |
| 4,577,428 | 3/1986 | Trame | 40/642 |
| 4,593,486 | 6/1986 | Visocky et al. | 40/649 |
| 4,821,440 | 4/1989 | Dunn | 40/642 |
| 5,044,104 | 9/1991 | Hopperdietzel | 40/642 |
| 5,189,822 | 3/1993 | Schmanski et al. | 40/642 |
| 5,237,767 | 8/1993 | Kringel et al. | 40/642 |
| 5,241,467 | 8/1993 | Failing et al. | 364/401 |
| 5,263,269 | 11/1993 | Tjarlund | 40/649 |

*Primary Examiner*—Steven J. Saras
*Attorney, Agent, or Firm*—Paul W. Martin

[57] ABSTRACT

An electronic shelf label mounting system which protects an electronic shelf label from damage. The mounting system includes a rail having rounded top and bottom surfaces and a channel containing an electronic display module. In the preferred embodiment, the channel is wider than the electronic display module. A cover protects the electronic display module from damage from causes such as contact with shopping carts. A hinge member pivotally couples the cover to the rail. In a second embodiment, the cover is hingeless. The preferred embodiment further includes wireless electrical connections between the electronic display module and the rail, including power and signal connections, and ground connections at a location sufficient to minimize static discharge between the ground connections and the power and signal connections. The preferred embodiment also includes a downwardly biased flexible locking pawl for locking the electronic display module in the channel which engages a groove within the channel. The pawl is raised by a key which is inserted into an inverted channel adjacent the lower surface of the electronic display module, the upper surface of the inverted channel being the lower surface of the flexible locking pawl. Another embodiment includes more than one locking pawl.

11 Claims, 5 Drawing Sheets

ELECTRONIC SHELF LABEL MOUNTING SYSTEM

BACKGROUND OF THE INVENTION

The present invention relates to retail shelving and price labels and more specifically to an electronic shelf label mounting system.

Electronic shelf label systems employ electronic shelf labels for displaying price information for items on the shelves. These systems normally include electronic display modules having liquid crystal displays and associated wiring harnesses. Many systems use wireless communication, but are expensive. To convey information such as item name, item size, and item bar code label, display tags are normally employed. The harnesses from each of the shelves are connected to a central controller where prices can be conveniently changed at one location. Electronic shelf label systems allow prices to be changed much more quickly than conventional printed and gummed labels.

Typically, electronic shelf labels are expensive and susceptible to damage from cans, shopping carts, cleaning solutions, and vandalism. Therefore, it would be desirable to produce an electronic shelf label mounting apparatus which can avoid such damage.

The wiring harnesses for electronic shelf labels normally pass through an aperture in the shelf rail, making installation of the electronic display modules difficult. Therefore, it would be desirable to produce an electronic shelf label mounting system which does not employ wires and which couples the electronic display module to the wiring harness upon insertion of the electronic display module into the shelf rail.

SUMMARY OF THE INVENTION

In accordance with the teachings of the present invention, an electronic shelf label mounting system is provided. The mounting system includes a rail having rounded top and bottom surfaces and a channel containing an electronic display module. In the preferred embodiment, the channel is wider than the electronic display module and includes an upper wall, a vertical wall, and a bottom wall.

A cover protects the electronic display module from damage from causes such as contact with shopping carts, and in the preferred embodiment includes a primary cover member, a flexible top lip member extending from the primary cover member over the top surface, and a bottom lip member extending from the primary cover member over the bottom surface. A hinge member, including a flange extending from the rail and a cylindrical member at the end of the bottom lip member and adjacent the flange, pivotally couples the cover to the rail. In a second embodiment, the cover is hingeless and includes a flexible bottom lip member.

The preferred embodiment further includes wireless electrical connections between the electronic display module and the rail, including power and signal connections, and ground connections at a location sufficient to minimize static discharge between the ground connections and the power and signal connections. In the preferred embodiment, power and signal connections are located on a first step in the upper wall of the electronic display module and a ground terminal is located on a second step lower than the first step.

The preferred embodiment also includes a downwardly biased flexible locking pawl for locking the electronic display module in the channel. The locking pawl includes a strip portion extending from the front of the electronic display module, and a triangular ridge portion at the rear end of the strip portion. The triangular ridge portion engages a similarly shaped groove within the channel. The pawl is raised by a key which is inserted into an inverted channel adjacent the lower wall of the electronic display module, the roof the inverted channel being the lower surface of the flexible locking pawl. Another embodiment includes more than one locking pawl.

It is accordingly an object of the present invention to provide an electronic shelf label mounting system.

It is another object of the present invention to provide an electronic shelf label mounting system which can protect electronic shelf labels from damage caused by cans, shopping carts, cleaning fluid, and vandalism.

It is another object of the present invention to provide an electronic shelf label mounting system which employs a protective cover.

It is another object of the present invention to provide an electronic shelf label mounting system which employs a locking mechanism for retaining the electronic display module in the rail.

It is another object of the present invention to provide an electronic shelf label mounting system which couples the electronic display module to the wiring harness upon insertion of the electronic display module into the shelf rail.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
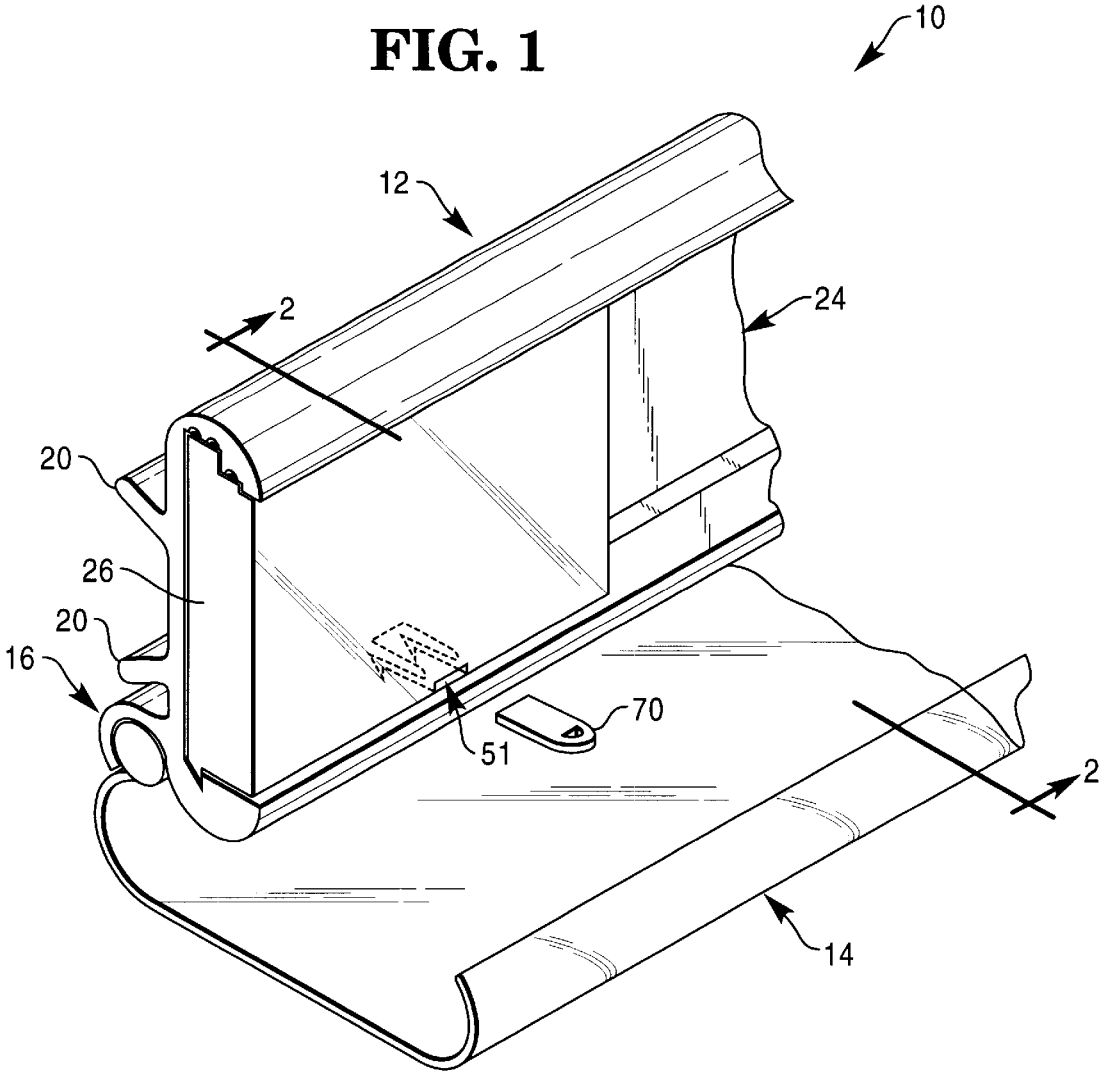
FIG. 1 is a perspective view of a shelf unit employing the preferred embodiment of the electronic shelf label mounting apparatus of the present invention.
Figure 2:
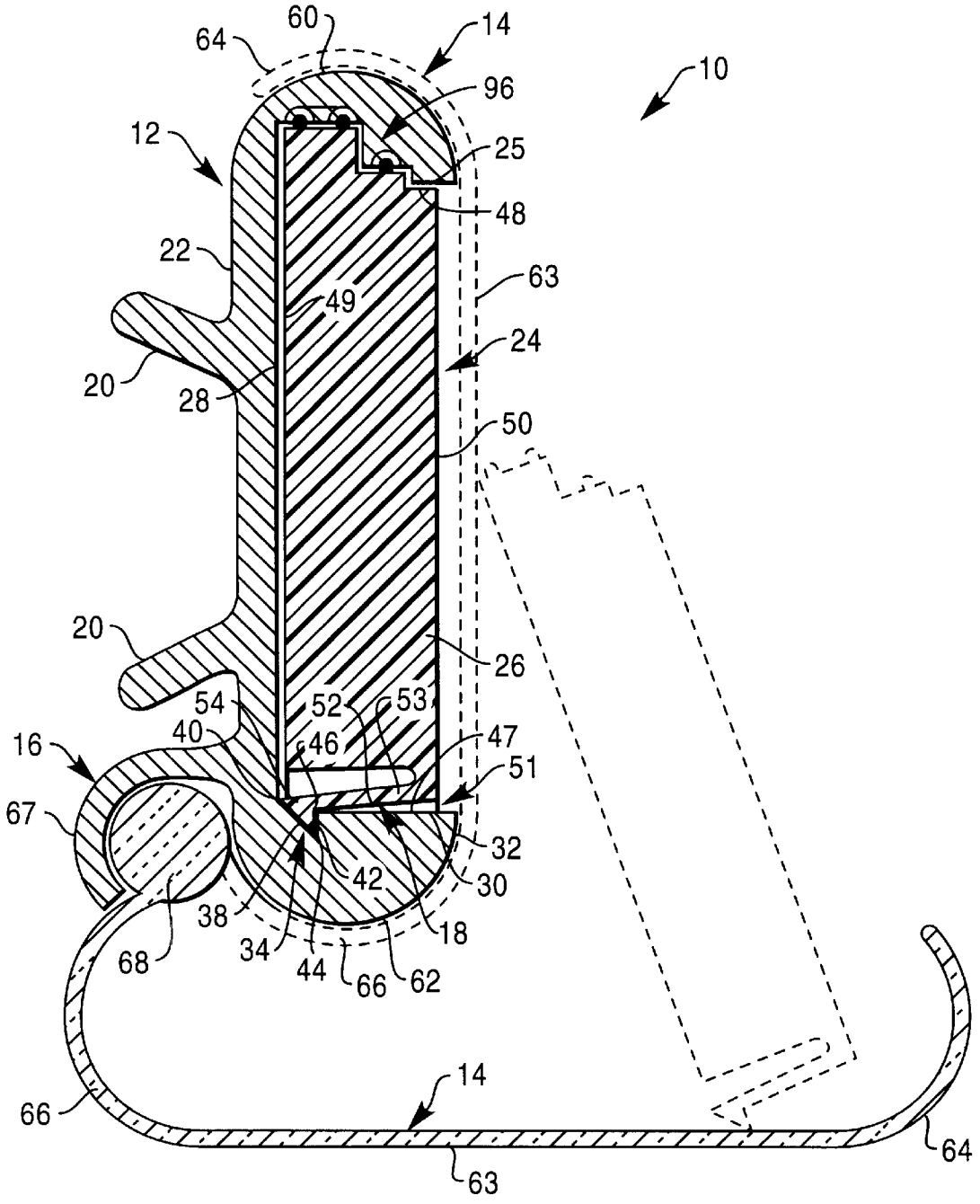
FIG. 2 is a sectional view of the shelf unit of FIG. 1.

Turning first to FIGS. 1 and 2, electronic shelf label (ESL) mounting system 10 includes rail member 12, cover member 14, hinge member 16 for coupling cover member 14 to rail member 12, and locking pawl 18.

Rail member 12 includes hook members 20 on the rear side 22 thereof for coupling rail member 12 to the front of a shelf (not shown) and channel 24 for containing electronic display module 26. Channel 24 is defined by upper wall 25, vertical wall 28, and lower wall 30. Access to channel 24 is through front side 32 of rail member 12.

In the preferred embodiment, channel 24 further includes groove 34 in lower wall 30. Groove 34 conforms to the shape of flexible locking pawl 18 on electronic display module 26 and in this embodiment includes inclined wall portion 38 originating at lower edge 40 of vertical wall 28 and vertical wall portion 42 connecting lower edge 44 of inclined wall portion 38 and inner edge 46 of lower wall 30.

Electronic display module 26 includes lower surface 47, upper surface 48, rear surface 49, and front surface 50, and conforms to the shape of channel 24, having a height equal to the height of vertical wall 28. The width of electronic display module 26 is slightly less than the width of channel 24 to protect electronic display module 26 from contact with shopping carts.

Additionally, electronic display module 26 includes inverted channel 51 adjacent its lower surface 47. One end of inverted channel 51 is in front surface 50 and in the preferred embodiment is rectangular in shape. Upper surface 52 of inverted channel 51 is the lower surface of flexible locking pawl 18. Flexible locking pawl 18 extends rearwardly from front surface 50 of electronic display module 26, where it is flexibly hinged, and includes rectangular strip portion 53 and triangular ridge portion 54 at the rear end of strip portion 53 having the same shape as groove 34. Flexible locking pawl 18 is downwardly biased for engaging ridge portion 54 with groove 34 to lockingly retain electronic display module 26 in channel 24.

Top and bottom surfaces 60 and 62 of rail member 12 are rounded and are generally circular in cross-section. Advantageously, this geometry minimizes damage to rail member 12 from contact with shopping carts, and cans being removed from the shelf.

Protective cover 14 made of transparent plastic protects electronic display module 26 from collisions with shopping carts and other routine wear. Protective cover 14 includes face member 63 that covers the front of rail member 12, resilient top lip member 64 extending from face member 63 over top surface 60, and bottom lip member 66 extending from face member 63 over bottom surface 62. In this embodiment, cover 14 is rotatably mounted about hinge member 16. Hinge member 16 includes flange 67 and cylindrical member 68 at the end of bottom lip member 66 and constrained by flange 67. Protective cover 14 is removed by applying enough force to cause resilient top lip member 64 to clear top surface 60.

Figure 3:
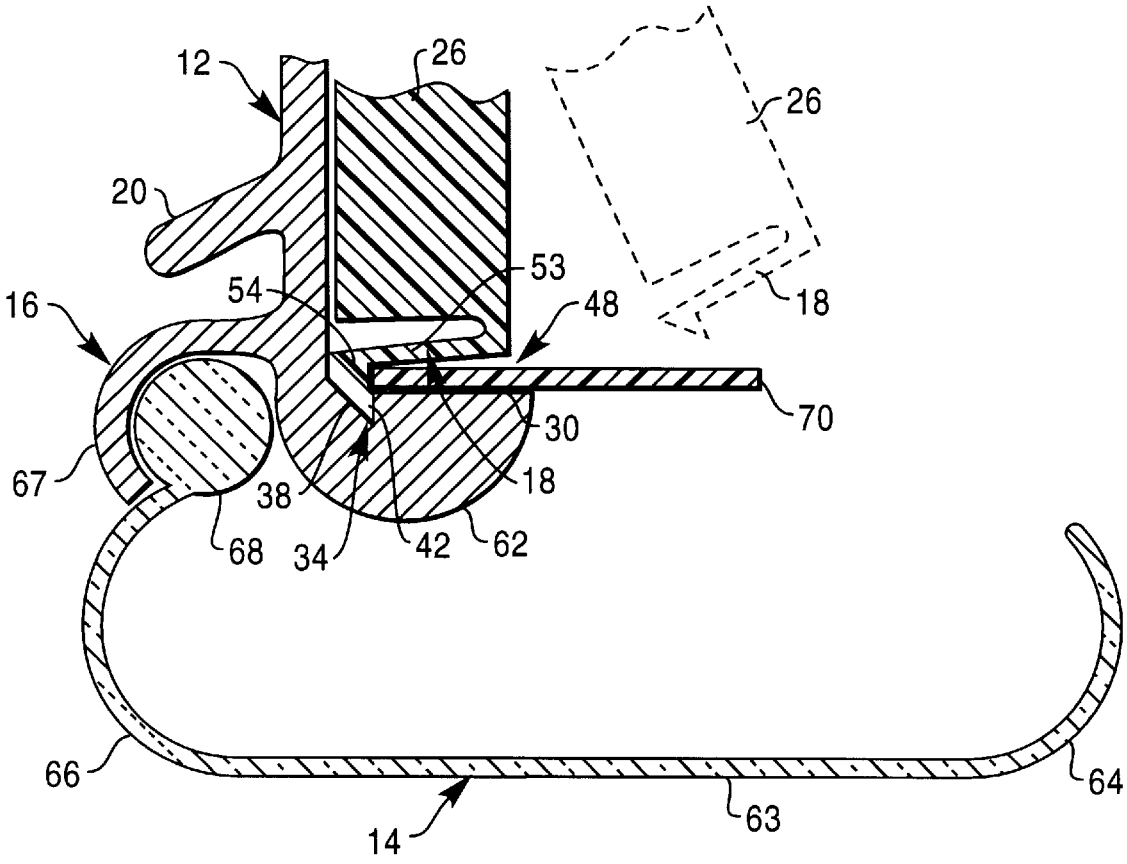
FIG. 3 is a partial view of FIG. 2, illustrating the installation and removal of the electronic display module.

Referring now to FIG. 3, key 70 is inserted into inverted channel 48 to force flexible locking pawl 18 upwards and unlock electronic display module 26 from channel 24. The bottom of electronic display module 26 is then brought forward out of channel 24.

Figure 4:
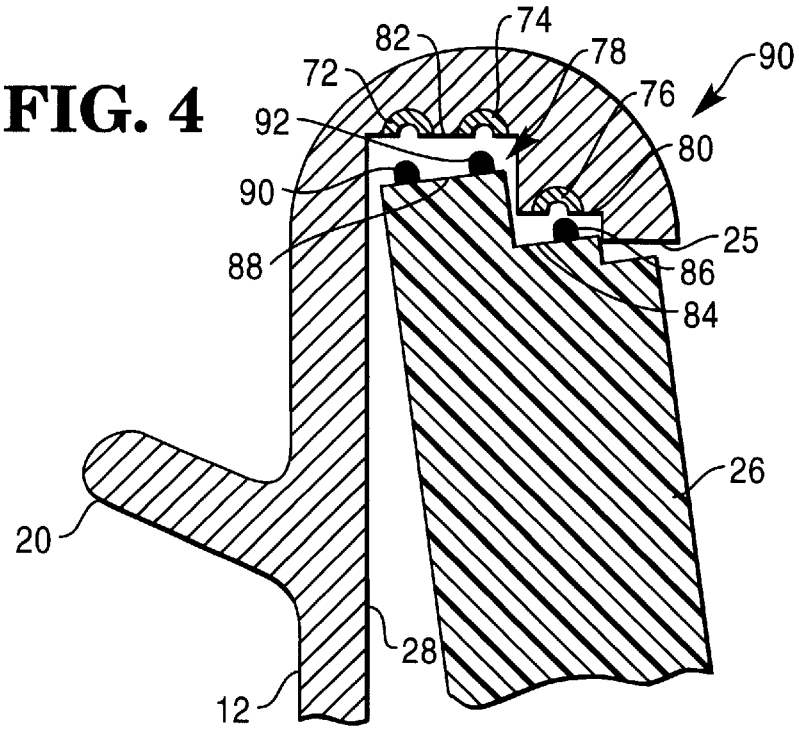
FIG. 4 is a partial view of FIG. 2, illustrating electrical connection of the electronic display module.

Referring now to FIG. 4, the electrical connections are shown in more detail. Receptacles 72, 74, and 76 are located within upper wall 25. Power and signal wires are connected to receptacles 72 and 74 and a ground wire is connected to terminal 76. Upper wall 25 includes L-shaped groove 78 having first ceiling portion 80 and second ceiling portion 82 higher than the first ceiling portion 80. By locating the electrical connections on the first and second steps, the connections are also isolated from the channel opening.

Electronic display module 26 has a shape similar to L-shaped groove 78. First step portion 84 is equipped with ground contact 86 and second step portion 88, higher than first step portion 84, has power and signal contacts 90 and 92. This design minimizes the possibility of electrostatic discharge to display 26 by placing the ground connections closer to a user and by separating ground connections 76 and 86 from power and signal connections 72, 90, 74, and 92.

Figure 5:
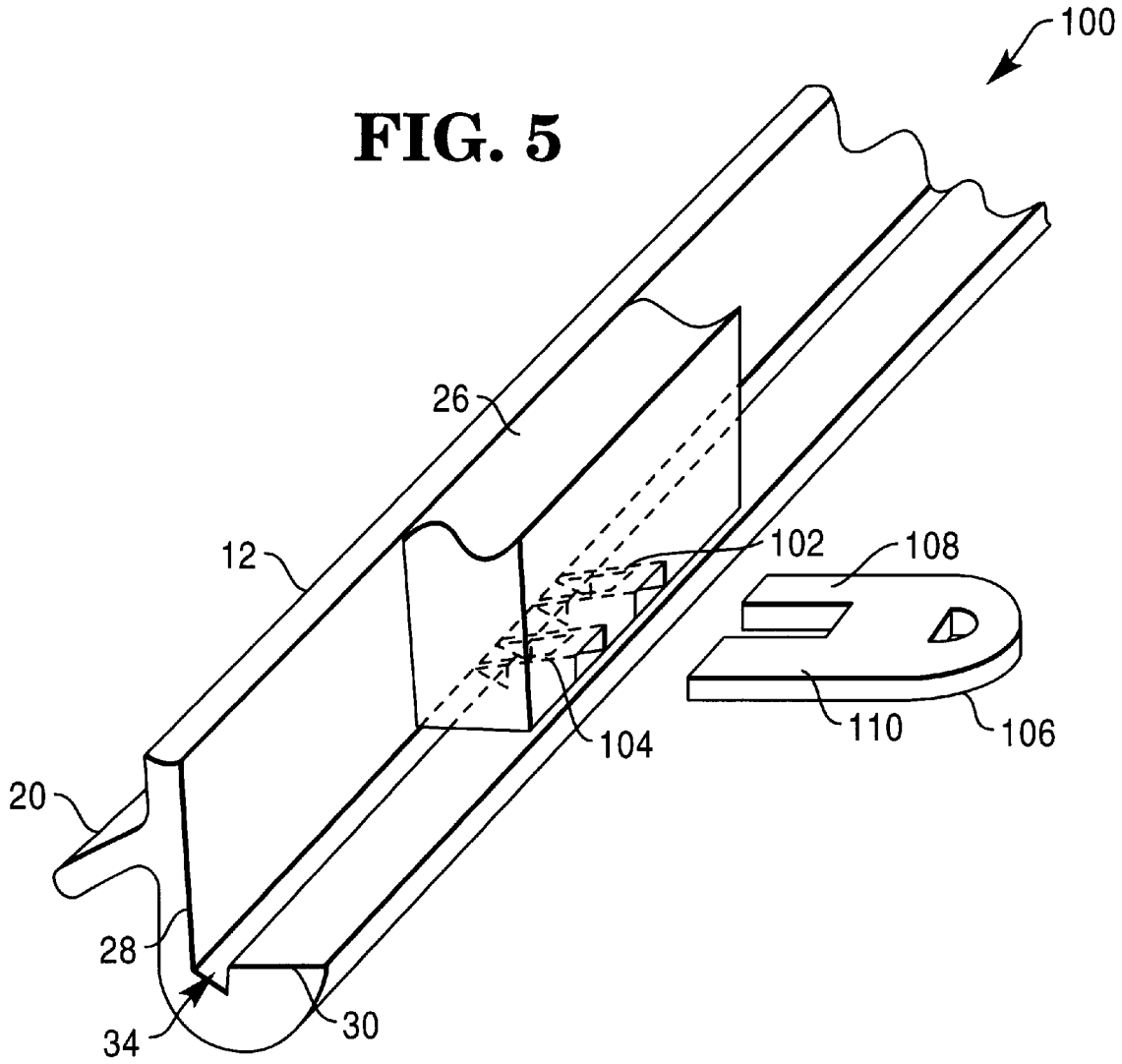
FIG. 5 is a perspective view of an alternative embodiment of the electronic shelf label mounting apparatus of the present invention.

Referring now to FIG. 5, alternative embodiment 100 includes electronic display module 26 employing two locking pawls 102 and 104 for added security. Key 106 having two parallel members 108 and 110, each having the same shape as key 70, is used to simultaneously unlock both locking pawls 102 and 104.

Figure 6:
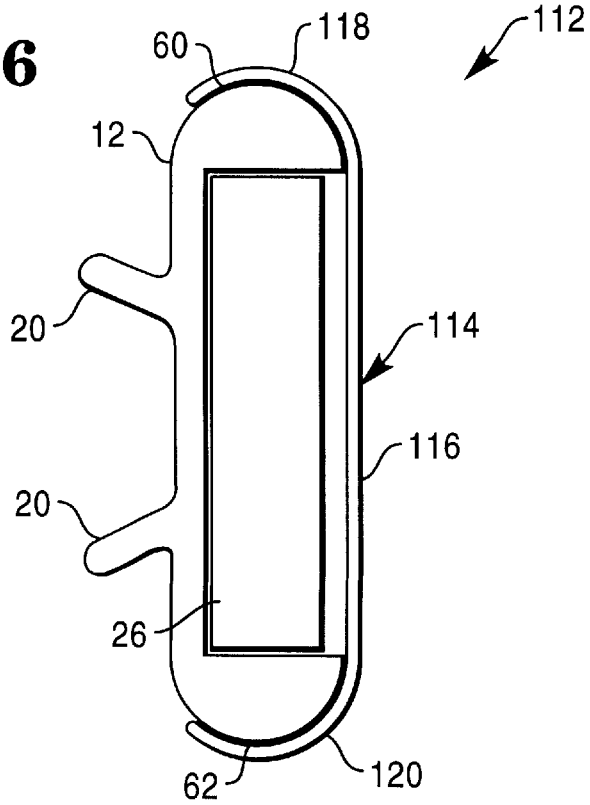
FIG. 6 is an end view of an alternative embodiment of the electronic shelf label mounting apparatus of the present invention.

Referring now to FIG. 6, alternative embodiment 112 employs hingeless protective cover 114. Protective cover 114 has face member 116 that covers the front of rail member 12 and resilient top and bottom lip members 118 and 120 extending from face member 116 over top and bottom surfaces 60 and 62. Protective cover 114 is removed by applying enough force to cause resilient top and bottom lip members 118 and 120 to spread apart and clear top and bottom surfaces 60 and 62.

Although the invention has been described with particular reference to certain preferred embodiments thereof, variations and modifications of the present invention can be effected within the spirit and scope of the following claims.

What is claimed is:

1. In an electronic shelf label system including an electronic display module for displaying price information, a mounting system comprising:

a rail, having rounded top and bottom surfaces and a channel defined by upper and lower walls joined by a vertical wall, for containing the electronic display module; and a cover for protecting the electronic display module including a primary cover member, a top lip member having a rounded shape conforming to the top surface of the rail and extending from the primary cover member over the top surface of the rail, and a bottom lip member having a rounded shape conforming to the bottom surface of the rail and extending from the primary cove member cover the bottom surface of the rail.

2. The system as recited in claim 1, further comprising a hinge member including a flange extending from the rail and a cylindrical member at the end of the bottom lip member and constrained by the flange.

3. The system as recited in claim 1, further comprising a wireless electrical connector between the electronic display module and the rail.

4. The system as recited in claim 3, wherein the wireless electrical connector comprises:

a power receptacle within the rail;

a signal receptacle within the rail;

a ground receptacle within the rail at a predetermined location sufficient to minimize static discharge between the ground receptacle and the power and signal receptacles;

a power terminal within the electronic display module positioned to operatively engage the power receptacle;

a signal terminal within the electronic display module positioned to operatively engage the signal receptacle; and a ground terminal within the electronic display module at a predetermined location sufficient to minimize static discharge between the ground terminal and the power and signal terminals positioned to operatively engage the ground receptacle.

5. The system as recited in claim 4, wherein the electronic display module has an upper surface, the system further comprising:

a first step portion in the upper surface of the electronic display module for mounting the ground terminal;

a second step portion in the upper surface of the electronic display module higher than the first step portion for mounting the power and signal terminals; and an L-shaped groove in the upper wall of the channel including a first ceiling portion for receiving the first step portion and for mounting the ground receptacle, and a second ceiling portion higher than the first ceiling portion for receiving the second step portion and for mounting the power and signal receptacles.

6. The system as recited in claim 1, further comprising a lock for locking the electronic display module in the rail.

7. The system as recited in claim 6, wherein the electronic display module has a front surface and wherein the lock comprises:

a flexible pawl extending from the front surface of the electronic display module including a strip member and a triangular member coupled to the strip member; and a triangular groove within the lower wall of the channel for receiving the triangular member when the electronic display module is inserted into the channel in a direction perpendicular to the rail.

8. The system as recited in claim 7, further comprising a key for unlocking the flexible pawl.

9. The system as recited in claim 7, further comprising:

another flexible pawl extending from the front surface of the electronic display module including a strip member and a triangular member coupled to the strip member; and means for simultaneously unlocking the one flexible pawl and the other flexible pawl.

10. The system as recited in claim 1, wherein the channel is wider than the electronic display module.

11. In an electronic shelf label system including an electronic display module for displaying price information having front and upper surfaces, a mounting system comprising:

a rail having rounded top and bottom surfaces and a channel containing the electronic display module, the channel being defined by upper and lower walls joined by a vertical wall and being wider than the electronic display module;

a cover for protecting the electronic display module including a primary cover member, a top lip member having a rounded shape confirming to the top surface of the rail and extending from the primary cover member over the top surface, and a bottom lip member having a rounded shape conforming to the bottom surface of the rail and extending from the primary cover member over the bottom surface;

a hinge member coupling the cover to the rail including a flange extending from the rail, a cylindrical member at the end of the bottom lip member and constrained by the flange;

a wireless electrical connector between the electronic display module and the rail including a first step portion in the upper surface of the electronic display module, a ground terminal within the first step portion, a second step portion in the upper surface of the electronic display module higher than the first step portion, a power terminal within the second step portion, a signal terminal within the second step portion, an L-shaped groove in the upper wall of the channel including a first ceiling portion for receiving the first step portion and a second ceiling portion higher than the first ceiling portion for receiving the second step portion, a ground receptacle within the first ceiling portion, a power receptacle within the second step portion, and a signal receptacle within the second ceiling portion;

a lock for locking the electronic display module in the rail including a flexible pawl extending from the front surface of the electronic display module including a strip member and a triangular member coupled to the strip member, and a groove within the lower wall of the channel for receiving the triangular member when the electronic display module is inserted into the channel in a direction perpendicular to the rail; and a key for unlocking the flexible pawl.

* * * * *

UNITED STATES PATENT AND TRADEMARK OFFICE

CERTIFICATE OF CORRECTION

PATENT NO. : 6,069,596

DATED : May 30, 2000

INVENTOR(S) : Russel Marvin et al.

It is certified that error appears in the above-indentified patent and that said Letters Patent is hereby corrected as shown below:

Column 4, line 31, delete "cover" and substitute --cover--.

Column 4, line 31, after "member" delete "cover" and substitute --over--.

Column 6, line 3, delete "confirming" and substitute --conforming--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*